United States Patent [19]

Rash

[11] 3,945,571

[45] Mar. 23, 1976

[54] SELF-CONTAINED PORTABLE PRESSURE APPARATUS AND HAND GUN ASSEMBLY

[76] Inventor: James E. Rash, 8884 W. Warren Drive, Denver, Colo. 80227

[22] Filed: Jan. 23, 1975

[21] Appl. No.: 543,259

[52] U.S. Cl. ..... 239/152; 239/337; 239/375; 222/136; 222/175

[51] Int. Cl.[2] ..... B05B 9/08; B05B 7/32

[58] Field of Search ..... 239/152, 153, 154, 337, 239/345, 375, 379, 376, 378; 222/136, 175, 396, 399, 529

[56] References Cited

UNITED STATES PATENTS

| | | | |
|---|---|---|---|
| 1,863,924 | 6/1932 | Dunn | 239/376 X |
| 2,083,039 | 6/1937 | Searls | 239/153 |
| 2,305,269 | 12/1942 | Moreland | 239/345 |
| 2,911,157 | 11/1959 | Converse | 239/152 UX |
| 2,932,127 | 4/1960 | Prance et al. | 239/152 UX |
| 3,802,511 | 4/1974 | Good | 239/154 X |
| 3,844,449 | 10/1974 | Alter | 239/154 X |

FOREIGN PATENTS OR APPLICATIONS

| | | | |
|---|---|---|---|
| 956,446 | 1/1957 | Germany | 239/378 |
| 746,918 | 3/1956 | United Kingdom | 239/379 |
| 946,078 | 1/1964 | United Kingdom | 239/152 |

*Primary Examiner*—Robert S. Ward, Jr.

[57] ABSTRACT

A portable self-contained pressure apparatus including a pressurized tank releasably fastened on a backpack carrier for carrying the tank on the back of a user during operation thereof while a handle attachment on the tank and backpack carrier assembly allows them to be manually carried to the point of use. A line pressure control and flexible hose coupling assembly couples the tank pressure to an air pressure responsive load device herein shown as a hand-held spray gun with a feed hopper for applying a texture coating to walls. The line pressure control reduces the tank pressure and affords selective pressure ranges as well as on-off pressure control to the spray gun. The line pressure control and flexible hose coupling assembly are detachable from the pressurized tank when not in use and carried in the feed hopper.

11 Claims, 7 Drawing Figures

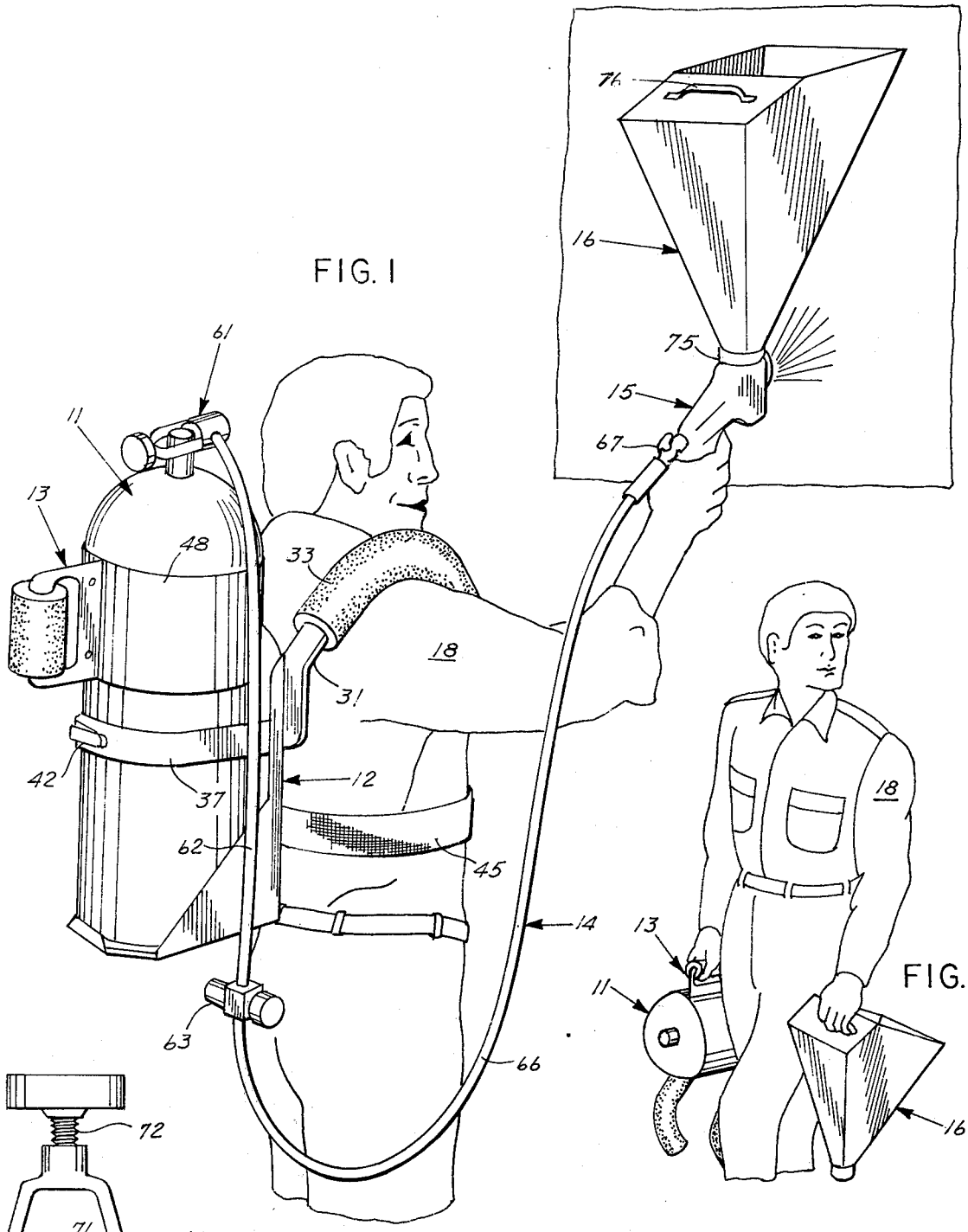
FIG. 1
FIG. 2
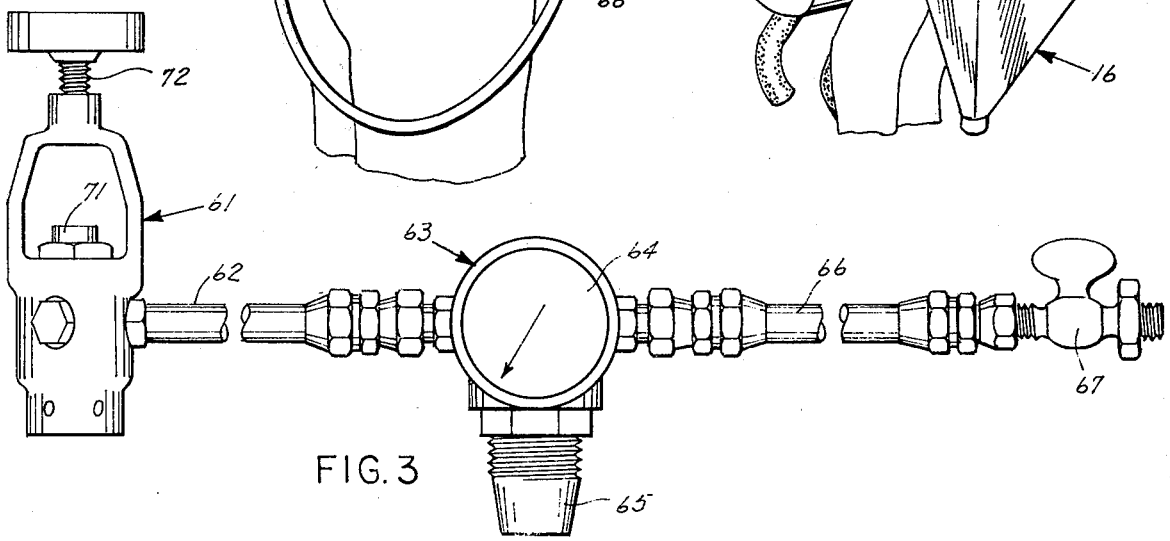
FIG. 3

SELF-CONTAINED PORTABLE PRESSURE APPARATUS AND HAND GUN ASSEMBLY

FIELD

This invention relates generally to pressure apparatus and more particularly to self-contained, portable pressure apparatus that is readily carried around by hand to the location needed and particularly suited for use with a spray gun for applying a texture coating material to walls for texture touchup and the like.

BACKGROUND

A significant problem with pressure-driven equipment, such as spray guns, is that the compressor, tank and electric and air flow lines are relatively heavy and difficult to manipulate for smaller scale operations. For example, in applying texture coating material to walls in a building structure, once the project is completed there are numerous areas which require touching up, such as scratches or areas around the light switches, etc. The equipment presently available for applying texture coating material requires a fairly cumbersome machinery weighing on the order of 80 to 100 pounds of equipment that includes a relatively large storage tank that requires the plugging of electric lines and numerous air lines to operate, together with an air compressor and a carrying around of these lines from place to place. During bad weather conditions, the use of this type of equipment with wheels and numerous lines usually results in the tracking of mud into the structure such as a building structure that is substantially completed. It is estimated that the minumum set up time for conventional equipment of the type described would be 1.5 hours.

Accordingly, it is an object of this invention to provide novel portable self-contained pressure apparatus that affords many advantages over presently used apparatus utilizing an air compressor, storage tank, electric cords and air lines.

Another object of this invention is to provide novel portable self-contained pressure apparatus in which there is no set up time of electrical cords and air lines, no wheels, quietness of operation and no appreciable clean-up after usage.

A further object of this invention is to provide a novel portable, self-contained pressurized apparatus that is highly mobile and may be carried around by hand to the location needed with a relatively lightweight pressure tank placed in a backpack carrier on the back of the user and is highly efficient in powering a number of air pressure driven loads such as air guns and the like.

Yet another object of this invention is to provide a novel self-contained pressure apparatus and hand spray assembly that is particularly suitable for texture touchup on walls characterized by being considerably lighter than conventional spray apparatus presently in use for this purpose and will afford considerable savings for this particular application.

Other objects, advantages and capabilities of the present invention will become more apparent as the description proceeds taken in conjunction with the accompanying drawings, in which;

FIG. 1 is a schematic perspective view of portable, self-contained pressure apparatus and spray gun embodying features of the present invention capable of being used to spray coat a wall surface;

FIG. 2 is a schematic perspective view of portable self-contained pressure apparatus and spray gun shown in FIG. 1 being hand carried in its entirety to the point of use;

FIG. 3 is a side elevation view of the line pressure control and coupling between the pressure tank and spray gun;

Figure 4:
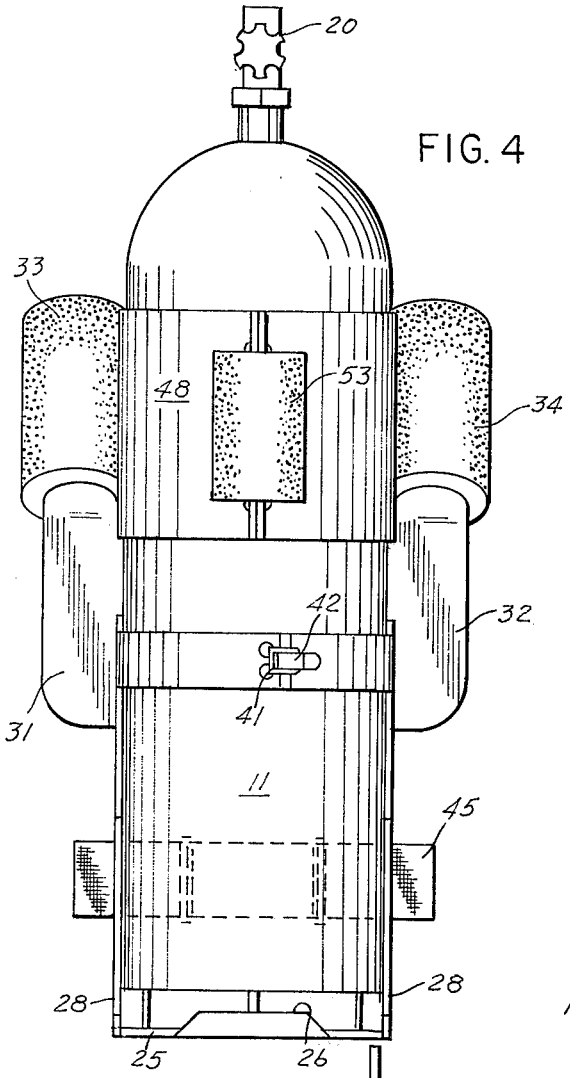
FIG. 4 is an elevation view of the backpack carrier and pressurized tank assembly as viewed from the handle side looking toward the back of the user.

Referring now to the drawings, there is shown self-contained portable pressure apparatus and hand spray gun assembly particularly suitable for spraying a texture coating material on walls, ceilings, etc. which in FIG. 1 is shown in an operating position. The apparatus shown in general is comprised of a pressurized air tank or cylinder 11 releasably mounted on a backpack carrier 12 together with a handle attachment 13 releasably fastened to the tank. A pressure control and coupling line 14 is coupled between an outlet of the tank and an inlet of a hand spray gun 15 having a feed hopper 16.

As shown in FIG. 1, the backpack tank carrier 12 is positioned on the back of a user represented at 18 and supports the pressurized air tank 11 while the spray gun 15 is held in one hand with the line 14 being sufficiently long to afford ease of movement of the spray gun. In FIG. 2, the combined pressurized tank and backpack carrier are shown carried in one hand the feed hopper 16 containing the spray gun 14 and control and coupling line 14 therein are carried in the other hand illustrating the high degree of mobility and portability the entire apparatus exhibits while being carried to a point of use at a work site.

The pressurized tank 11 is a conventional high pressure air cylinder or bottle normally filled with compressed air to a pressure of about 2,500 pounds per square inch, the tank having an on-off control valve 20 on top regulated by a knob 21 and also having a tapered recess around an outlet 22 surrounded by an O-ring 23. The pressurized tank 11 complies with OSHA safety standards.

Figure 5:
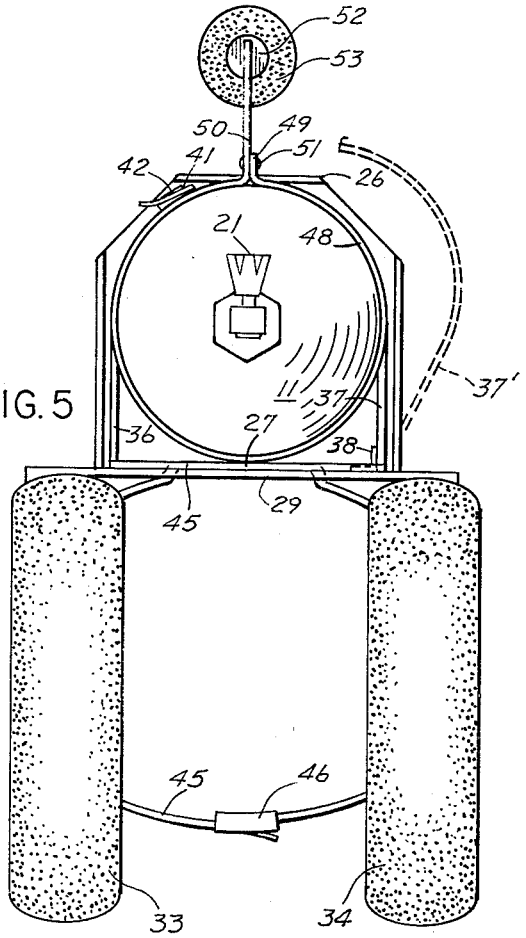
FIG. 5 is a top plan view of the backpack carrier and tank assembly of FIG. 4.
Figure 7:
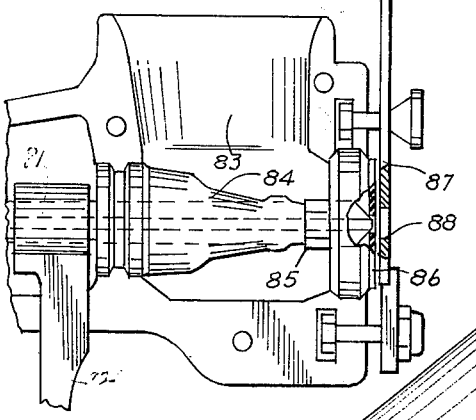
FIG. 7 is a fragmentary side elevation view of the spray gun to show interior construction.
Figure 6:
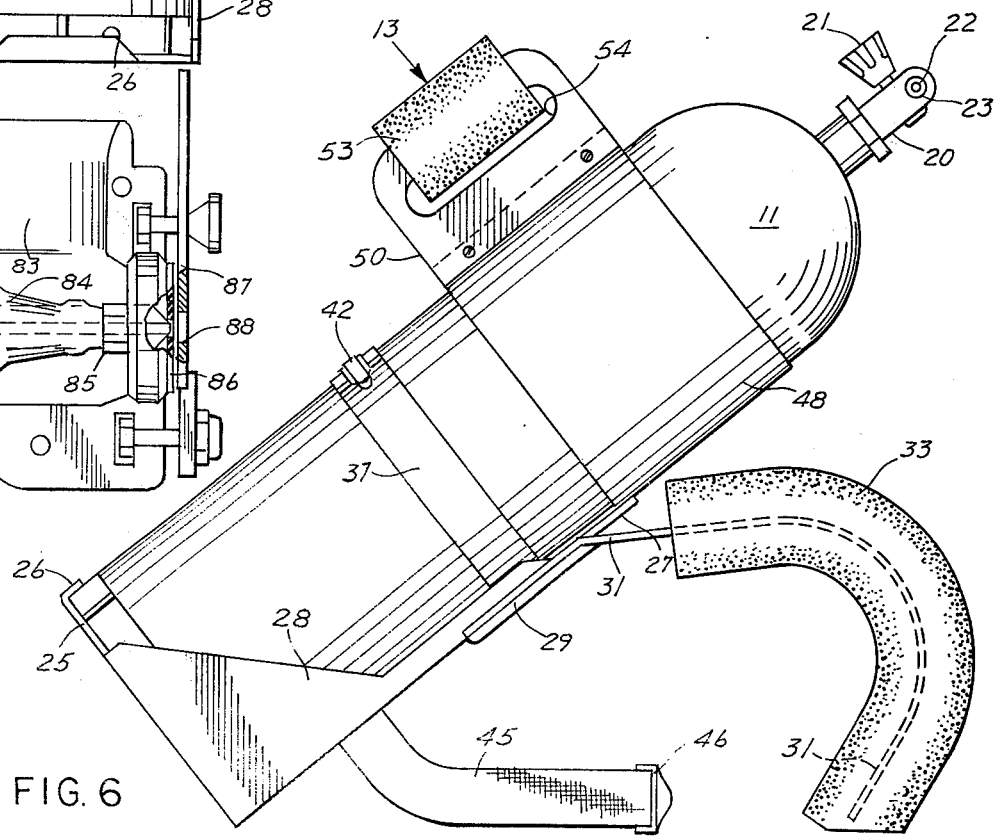
FIG. 6 is a side elevation view of the assembly of FIGS. 4 and 5 in an at rest position on a floor or like support surface.

The backpack tank carrier 12 shown in more detail in FIGS. 4 through 6 is comprised of a generally L-shaped support frame adapted for supporting the tank having a flat base plate 25 with an upturned retaining flange 26 on one edge and an upright support plate 27 extending up from an edge of the base at right angles thereto and opposite the retaining flange 25 for providing a back side for supporting the tank. A side gusset plate 28 is secured at the side at each corner between the base plate 25 and upright support plate 27. An auxiliary plate 29 is secured across the upright support plate 27 providing a pair of side extensions beyond the side edges of the upright support plate. A rigid shoulder strap 31 is affixed at one end on a side extension of the auxiliary plate to be essentially flush with plate 27 and extends up, out away from and back down so as to be generally arcuate to fit over the shoulders of the user. In turn, a rigid shoulder strap 32 is affixed to the other side extension of the auxiliary plate 29. A cushion member 33 of a rubber or rubberized material fits over the strap 31 and a similar cushion member 34 on strap 32 to engage the shoulders of the user for comfort. The shoulder straps 31 and 32 are constructed and arranged on the frame so that when disposed on its side as shown in FIG. 6 with the corner of the frame on a support surface, the shoulder straps dispose the tank at an angle of inclination with the upper end portion of the tank substantially above the support surface and the angle and weight distribution of the tank is such that there is no tendency to tip over toward the top so as to damage the tank valve 20. In this way the tank valve 20 is protected against an accidental sharp blow or the like.

For releasably securing the tank to the carrier frame there is shown an arcuate stationary arm 36 that is affixed at one end to an upper portion of the upright support plate 27 and is curved to extend partially around the tank and an arcuate movable arm 37 that is pivotally attached to the upright support plate 27 by means of a hinge 38 so that it will extend partially around the opposite side and co-operate with the stationary arm 36 to secure the tank to the carrier. A releasable buckle-type fastener is secured at the free ends of the support arms. This fastener is conventional and is in the form of a hook 41 on the movable arm 37 and loop and lever member 42 on the stationary arm 36 so that when the lever is pivoted to one side it is closed and the arms are tightly held against the tank and when pivoted to the other side the loop is moved out of the hook. The movable arm 37 is shown in an open position in dashed lines at 37' in FIG. 5 allowing the tank to be removed from the carrier.

To provide for manually carrying the backpack carrier 12 and tank 11 assembly to the point of use the handle attachment 13 is releasably mounted on an upper portion of the tank. This handle attachment 13 has a C-clamp portion 48 in the form of relatively wide plate bent along its length to conform to the circular transverse cross section of the tank in a C-clamp arrangement and further has a pair of opposed extended portions 49 and 50 through which screw fasteners 51 extend so that it clamps firmly against the tank. Extension 50 is elongated and terminates in a rounded grip portion 52 covered by a cylindrical hollow cushion 53 and is also provided with a slot 54 allowing the user to insert the fingers into the slot and grip the cushion and grip portion 52. The handle attachment 13 is located on a center line above the midpoint between the top and bottom of the tank so that when the handle is gripped, there is a counter balancing effect whereby the lower part of the tank remains in a dependent lowermost position.

For further releasably securing the carrier frame to the user there is provided a belt 45 that extends through a pair of slots in the support plate to extend around the body of the user together with a buckle 46 on the free ends of the belt to fasten said free ends of the belt together.

The line pressure control and hose coupling 14 comprise a conventional pressure regulator tank valve 61 adapted to be releasably coupled to the valve 20 on the tank having an outlet coupled by a length of flexible hose 62 to the inlet of a pressure regulator 63 having a pressure indicator 64 and control knob 65. A commercially available regulator 63 is Wilkerson No. 2019-21. A length of flexible hose 66 is coupled to the outlet of the pressure gauge to the inlet of an on-off air valve 67 which in turn coupled to the inlet of the spray gun 15. Conventional brass fittings are shown on the ends of the flexible hoses and these fittings are attached to the tank valve 61, pressure regulator gauge 62 and on-off valve 67 in sequence in the flow line.

The tank valve 61 is a conventional commercially available unit and has a portion 71 that fits over the O-ring 23 on the valve 20 and a threaded screw 72 that releasably locks the tank valve 61 in place on the top of the tank as shown in FIG. 1. The pressure regulator tank valve 61 reduces the tank pressure from about 2,500 psi to 110 to 95 psi. In turn, the pressure gauge will control the pressure from 110 psi down to 0 psi to give a full range of pressure control for operating the spray gun or like load. The on-off valve 67 permits the selective shutting off of the pressure to the spray gun entirely.

The spray gun shown is conventional Pattern Piston such as that sold by Goldblatt. The feed hopper 16 is releasably held on the gun by a hose clamp 75 at its lower end. The feed hopper has a handle 76 and an open upper end into which the fluent coating material is poured. In the hand carrying of the apparatus as shown in FIG. 2 the spray gun 15 and line pressure control and coupling assembly is placed in the hopper.

The spray gun shown has an air pressure inlet 81, a spring biased control trigger 82, a material cavity 83 receiving material from the feed hopper 16 by gravity flow, a rubber jacket 84 with a hollow beveled head 85 is movable against a rubber washer 86 whereby as the trigger 82 is pulled back, compressed air forces the material through an aperture in the rubber washer 86. The gun also has a ring 87 forming an outlet orifice 88 alines with the rubber washer that determines the pattern. These things will affect the texture of the material being sprayed: the size of the orifice 88, the liquid state of the material and the air pressure.

OPERATION

In a full sequency of operation for the above described apparatus, the pressurized tank 11, backpack carrier 12 and handle attachment 13 are carried in one hand, the line pressure control, hose couplings 14 and spray gun 15 placed inside the feed hopper 16 and carried in the other hand. At the point of use the pressure regulator valve 61 is coupled to the tank and the valve 20 turned on, the regulator valves 61 and 63 are set to the desired pressure and the shoulder straps 31 and 32 are placed over the shoulders and the belt 45 positioned around the user's body and the buckle 46 fastened as shown in FIG. 1.

The feed hopper is filled with the fluent coating material and when ready to spray, the on-off valve 67 is opened. The hand gun is directed toward a wall surface and the trigger 82 is pulled back producing a spraying of the material on the wall surface toward which it is directed.

While the above described pressure apparatus is particularly suitable for driving a pistol pattern hand spray gun for applying a texture coating material as above described, it should be understood that it is also applicable to the other types of pressure driven hand devices such as nail guns, paint guns and the like.

Although the present invention has been described with a certain degree of particularity, it is understood that the present disclosure has been made by way of example and that changes in details of structure may be made without departing from the spirit thereof.

What is claimed is:

1. A portable, self-contained pressure apparatus readily carried around by hand to the location of operation and supported primarily by the back of a user when in operation, said apparatus comprising, in combination:

a pressurized tank, a backpack carrier adapted to be releasably mounted on the back of a person, said carrier having a tank support frame and releasable tank fastening means on the support frame for releasably fastening the pressurized tank to the support frame, said carrier having a pair of laterally spaced, generally arcuate rigid shoulder straps attached at one end to an upper portion of said upright portion extending out away and then down therefrom to mount the tank support frame on the shoulders of the user and to dispose said support frame and tank at an angle of inclination with the tank outlet and at an elevated position in a demounted at rest position.

handle means for hand carrying the backpack carrier and tank to a point of use, said handle means including a C-clamp portion surrounding the tank positioned and centered about the midpoint between the top and bottom of the tank, releasable fastening means holding the C-clamp portion on the tank and a handle grip portion affixed to and disposed a distance away from said C-clamp portion, a line pressure control and coupling means coupled to said tank to regulate the amount of air pressure from said tank to a pressure responsive load device, and a pressure driven spray gun coupled to the output of said line pressure control and coupling means, said spray gun being a pattern spray gun for spraying a fluent texture coating material on walls and the like, said spray gun having a feed hopper for storing a batch of fluent texture coating material and delivering said material to the spray gun which selectively sprays the material in response to air pressure from said line pressure control and coupling means.

2. A portable, self-contained pressure apparatus as set forth in claim 1 wherein said tank support frame is generally L-shaped with a base portion and an upright portion and fastening means on the upright portion extending around the tank and releasably connected at the ends to fasten the tank to the support frame.

3. A portable, self-contained pressure apparatus as set forth in claim 1 wherein the center of gravity of the tank on the carrier support frame is closer to the bottom than the top in the at-rest position so that the assembly does not tend to tip toward the top.

4. A portable, self-contained pressure apparatus as set forth in claim 1 wherein said backpack carrier has a belt extending through slots in the support frame adapted to extend around the body of the user and having a releasable fastener at the free ends to fasten the support frame to the body of the user.

5. A portable, self-contained pressure apparatus as set forth in claim 1 wherein each of said shoulder straps includes a rigid core portion and an outer resilient cushion portion.

6. A portable, self-contained pressure apparatus as set forth in claim 1 wherein said grip portion handle means includes a rigid annular core portion and an outer resilient cushion portion together with a slot adjacent the grip portion.

7. A portable, self-contained pressure apparatus as set forth in claim 1 wherein said pressurized tank has a flow control valve at the top.

8. A portable, self-contained pressure apparatus as set forth in claim 7 wherein said line pressure control and coupling means includes:

a first pressure regulator valve removably mounted on the flow control valve of the tank to reduce the tank pressure, a second pressure regulator valve coupled to said first regulator valve having a pressure indicator and a manually operable pressure adjustment member to vary the pressure over a lower range down to zero pressure, and an on-off valve coupled to said second pressure regulator valve to selectively turn the pressure from the tank on and off.

9. A portable, self-contained pressure apparatus as set forth in claim 8 wherein there is provided a first flexible flow line coupled between said first and second pressure regulator valves and a second flexible flow line coupled between said second pressure regulator valve and said on-off valve.

10. In portable, self-contained pressure apparatus as set forth in claim 9 wherein said on-off valve has coupling means to releasably couple the on-off valve to a pressure responsive load device.

11. Portable self-contained pressure and spray apparatus as set forth in claim 1 wherein said feed hopper has a handle and a top opening and is sized to receive said line pressure control and coupling means and said spray gun when detached from said tank.

* * * * *